US006471470B2

(12) United States Patent
Yoshimura et al.

(10) Patent No.: US 6,471,470 B2
(45) Date of Patent: Oct. 29, 2002

(54) VANE ADJUSTMENT MECHANISM FOR VARIABLE CAPACITY TURBINE, AND ASSEMBLING METHOD FOR THE SAME

(75) Inventors: Hyoji Yoshimura; Yoshihiro Ishihara, both of Kyoto; Takashi Mikogami, Tokyo, all of (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/791,737

(22) Filed: Feb. 26, 2001

(65) Prior Publication Data

US 2002/0119042 A1 Aug. 29, 2002

(51) Int. Cl.[7] ..... F01D 25/02

(52) U.S. Cl. ..... 415/160; 415/163; 415/209.3; 415/209.4; 415/210.1

(58) Field of Search ..... 415/160, 163, 415/191, 208.2, 209.3, 209.4, 210.1; 417/405, 406, 407; 60/600, 602, 603

(56) References Cited

U.S. PATENT DOCUMENTS 2,860,827 A 11/1958 Egli
4,582,466 A * 4/1986 Szczupak ..... 415/150
4,684,319 A * 8/1987 Sasaki ..... 415/164
4,696,620 A 9/1987 Ruetz et al.
4,726,744 A 2/1988 Arnold
4,804,316 A * 2/1989 Fleury ..... 417/407
5,518,365 A 5/1996 Baets et al.

* cited by examiner

*Primary Examiner*—Edward K. Look
*Assistant Examiner*—Ninh Nguyen
(74) *Attorney, Agent, or Firm*—Wenderoth, Lind & Ponack, L.L.P.

(57) ABSTRACT

A vane adjustment mechanism, for controlling the quantity of exhaust gas including a base unit having an inner base unit and an outer base unit. The inner base unit (2A) has first and second flanges, and is forced into the outer base unit (2B). A plurality of U-shaped indentations (2*c*) are spaced at regular angular intervals and each indentation extends from the first flange (2*a*) to the second flange (2*b*), so that the U-shaped indentations form vane shaft holes for accommodating the vane lever units (3) when the inner base unit is inserted into the outer base unit to block the U-shaped indentations in such a way that the vane lever units are free to rotate. A link plate (4) has U-shaped indentations, in which protrusions of the vane lever units (3) engage, all along the circumferential edge of the link plate.

5 Claims, 9 Drawing Sheets

VANE ADJUSTMENT MECHANISM FOR VARIABLE CAPACITY TURBINE, AND ASSEMBLING METHOD FOR THE SAME

BACKGROUND OF THE INVENTION

1. Field of the Invention

This invention concerns a vane adjustment mechanism used in a variable-capacity turbine to control the quantity of exhaust gas. The vane adjustment mechanism has fewer parts and a simpler configuration than its predecessors, which will operate in a stable fashion, and which will be highly durable. This invention also concerns the assembling method for the vane adjustment mechanism.

2. Description of the Related Art

The question of how to make exhaust gases cleaner, i.e., how to reduce the harmful nitrous oxides (NOx) and particulates in the exhaust, has become an environmental concern, particularly with respect to diesel engines. On the other end of the spectrum, the dynamic capability of a diesel engine, i.e., its torque and its output, can be increased by installing a turbocharger. In a turbocharger, a turbine powered by the exhaust gas is used to drive an air compressor which can supply a large quantity of intake air to the engine. Forcing more air into the engine will boost the rate of combustion in the engine and so increase its output.

Since the details of turbochargers are known to the public, we shall not explain them here; however, one means which has been employed to meet the demands in a diesel engine, as well as to increase its dynamic capabilities, is a turbocharger with a vane adjustment mechanism equipped with variable capacity vanes to control the quantity of exhaust gas from the engine.

As can be seen in FIG. 7, the vane adjustment mechanism 51 to control the quantity of exhaust gas lies within turbine housing 61 of turbocharger 60, which is installed on intake pipe E1, which runs into engine E, and exhaust pipe E2. Mechanism 51 is on the outside of turbine blades 63 on one end of shaft 62. In FIG. 7, 64 is the compressor impeller provided on the other end of turbine shaft 62.

A prior art design for a vane adjustment mechanism 51 to control the quantity of exhaust gas is shown in FIGS. 8 and 9. 52 is a base unit formed by a short pipe member on the end of which is base flange 52*a*. The turbine blades 63 fit inside the interior of base unit 52 and are coaxial with it.

A second flange, 52*b*, is formed on the end of base unit 52 opposite of that where flange 52*a* is formed. A number of vane shaft holes 52*c*, which are equal in number to the nozzle vane units 53 that go from flange 52*a* to flange 52*b*. A cover 52*d* protects nozzle vane units 53, which will be discussed shortly, on flange 52*a*.

Each nozzle vane unit 53 is a variable capacity vane, and it has a vane shaft 53*a* slipped into vane shaft hole 52*c*, which fits to the vane shaft 53*a*. The nozzle vane unit 53 protrudes from flange 52*a* at a right angle with respect to the surface of that flange. The angle of inclination of the surface of the nozzle vane unit 53 can be adjusted between a radius angle and an arc angle with respect to the center of base unit 52. One end of vane shaft 53*a* has nozzle vane unit 53, and the opposite end of the vane shaft 53*a* is fixed by riveting to the drilled hole 54*a* of lever 54, to be discussed shortly.

54 is a lever on top of flange 52*b*. The number of these levers 54, is equal in number to the nozzle vane units 53. A through hole 54*a* is provided on one end of lever 54 through which vane shaft 53*a* of nozzle vane unit 53, runs through to base unit 52. On the other end of lever 54, on the surface opposite that of which nozzle vane unit 53 is located, is a protrusion 54*b*, which engages with one of holes 55*a* of link plate 55, which will be discussed shortly.

The end of vane shaft 53*a* of nozzle vane unit 53, the insert shaft in hole 54*a* of lever 54, is riveted so that the nozzle vane unit 53 and the lever 54 form a single piece. Thus, both of the nozzle vane unit 53 and lever 54 are connected through base unit 52. Since the end of vane shaft 53*a* is riveted, the movement of lever 54 will change the angular orientation of the surface of nozzle vane unit 53.

55 is a link plate. The rounded center portion of link plate 55 engages with the outer surface of base unit 52. There is an eccentric hole 55*a* over the arc of the rounded portion, in which protrusion 54*b* of lever 54 engages. Link plate 55 also has a link portion 55*b* on a portion of the circumference of the plate, to engage with actuator unit.

A vane adjustment mechanism 51 to control the quantity of exhaust gas configured as described above is driven with an actuator (not pictured) connected to link portion 55*b* of link plate 55. When link plate 55 rotates over a given angle of rotation, the protrusion 54*b* of lever 54 rotates, and the other end of lever 54 which is fixed to the vane shaft 53*a* also rotates. In this way vane shaft 53*a* is made to rotate as a shaft, and the angle of nozzle vane unit 53 changes. A vane adjustment mechanism 51 which is driven in this way can adjust the quantity of exhaust gas to turbocharger 60 so as to optimize the function of the engine.

The prior art vane adjustment mechanism 51 to control the quantity of exhaust gas, which is shown in FIGS. 8 and 9, requires that the vane shaft hole 52*c*, provided in base unit 52 for vane shaft 53*a* of nozzle vane unit 53, be drilled to precise dimensions. Forming such a hole 52*c* during the manufacture of mechanism 51 requires careful labor. Also, because vane shaft 53*a* must fit closely in vane shaft hole 52*c*, particulates in the exhaust gas which adheres to its surface will fuse to the inserted shaft and the surface of vane shaft hole 52*c*, adversely affecting its durability.

The prior art vane adjustment mechanism 51 has a lever 54 and a vane shaft 53*a* which are riveted together. This requires a number of components, such as vane shaft 53*a* (nozzle vane unit 53) and lever 54, thus increasing both the parts count and the number of assembly processes. Just as was discussed earlier, these components also require a high degree of precision machining. Determining the correct position (i.e., the proper angle) at which to fix nozzle vane units 53 to levers 54 also required a high degree of precision.

In prior art vane adjustment mechanisms 51, the same problem as described above was experienced between hole 55*a* in link plate 55 and protrusion 54*b* of lever 54.

The high degree of machining precision which is required in prior art vane adjustment mechanism 51, to control the quantity of exhaust gas required in order to withstand being used under severe conditions in a turbocharger, increased the labor and the cost required to produce it. In addition, it required a large number of components, which complicated its configuration and increased the production time, reducing the efficiency of production and increasing its cost.

SUMMARY OF THE INVENTION

This invention was developed to solve the problems described above. The object of this invention is to provide a vane adjustment mechanism to control the quantity of exhaust gas, which will have fewer components and a simpler design, which will operate in a stable fashion, and which will be extremely durable.

In order to achieve these objectives, the vane adjustment mechanism, according to this invention, has the following essential features. With respect to the base unit and the link plate in which holes were formed by drilling, according to the prior arts vane adjustment mechanism, this invention uses a U-shaped indentation so as to eliminate the drilling process for forming a through hole. With respect to the components to adjust the vanes and the levers in a prior art mechanism to control the quantity of exhaust gas, which were composed of numerous parts, this invention uses a single part for the purpose of reducing the parts count. With respect to the insert shaft in the vane lever unit, which was linear in the prior art mechanism to control the quantity of exhaust gas, this invention narrows the diameter of the insert partway along its length in order to reduce the precision machining process for making the shaft. By selecting some or all of these improvements, the manufacturer can reduce the number of parts required, simplify the configuration of the mechanism, improve its operational stability and durability, and improve the assembling method for the vane adjustment mechanism.

The vane adjustment mechanism to control the quantity of exhaust gas which is disclosed in this application has a base unit having the shape of a short pipe, which has a first flange on an outer surface and a second flange on the inner side in the direction of exhaust gas; a plurality of vanes positioned along the circumference of the base unit, which adjust the quantity of exhaust gas; a link plate provided on the second flange of the base unit, whose inner circular edge engages with the outer edge of the base unit in such a way that the link plate is free to rotate; and a plurality of vane lever units connecting the plurality of vanes and the link plate, which run through vane shaft holes in the base unit.

The mechanism is distinguished be the following configuration. The base unit comprises an inner base unit having the first and second flanges, and an outer base unit into which the inner base unit 2A is forced, and a plurality of U-shaped indentations spaced at regular angular intervals on the inside surface of the inner or outer base unit from the first flange to the second flange, so that the U-shaped indentations form the vane shaft holes to accommodate the vane lever units when the inner base unit is forced into the outer base unit to block the U-shaped indentations in such a way that the vane lever units are free to rotate. In the assembling method according to this invention, the same features are distinguished from the prior art.

When the inner base is forced into the inner base in this fashion, a portion of each indentation will be blocked. As a result, the indentations will function as vane shaft holes. In other words, if indentations are provided on either the inside of the outer base unit or the outside of the inner base unit, no punching process will be needed. Furthermore, there will be less area which must be finished with a reamer, so the work required to manufacture the mechanism is simpler.

The vane and the vane lever unit are formed as an integral piece. As an actual configuration, it has vane units placed on top of the first flange, each of which consists of a vane whose surface is orthogonal to that of the first flange; and levers, each of which consists of a vane shaft extending from the vane unit toward the second flange and engaging in one of the indentations; a connector linked to this vane shaft which lies parallel to the surface of the second flange; and a protrusion which is linked to this connector and runs perpendicular to the surface of the second flange. The vane unit and lever are formed as an integral piece.

By forming the vane unit and lever as a single piece, we can reduce the parts count and by the same token reduce the number of assembly processes. In addition, we eliminate the need to determine the correct angle between the lever and the surface of the vane unit, which reduces the labor required.

The link plate has U-shaped cutting or concaved indentations, in which protrusions of the vane lever unit engage, all along the circumferential edge of the link plate. When compared with the process of providing holes in the link plate, this process provides superior strength with respect to thermal deformation and is easier to perform.

The mid-portion of a vane shaft of the vane lever unit has a narrow portion which has a smaller diameter than the ends of the vane shaft, which reduces the contacting surface area with the U-shaped indentation so preventing the vane shaft from seizing in the U-shaped indentation. Making the central portion of the vane shaft narrower will keep the vane shaft from coming in less contact with the surface of the indentation. This will eliminate the need for precision finishing and so shorten the production time by that amount. It will also prevent the parts from seizing.

BRIEF DESCRIPTION OF THE DRAWINGS

FIG. 1(*a*) is a view from the link plate side of the vane adjustment mechanism, and FIG. 1(*b*) is an enlarged view of a vane lever unit.

FIG. 3(*a*) is a view showing the second flange side of the base unit, and FIG. 3(*b*) is a cross section taken along line C—C of FIG. 3(*a*) showing the inner base unit being inserted into the outer base unit.

FIG. 4(*a*) is a view from the protrusion side of the actuator vane link unit, and FIG. 4(*b*) is a side view of the actuator vane link unit shown in FIG. 4(*a*).

FIG. 5(*a*) is a top view of the link plate, and FIG. 5(*b*) is a cross sectional view taken along line D—D of FIG. 5(*a*).

FIG. 6(*a*) is a top view of the link plate, and FIG. 6(*b*) is a cross sectional view taken along line E—E of FIG. 6(*a*).

FIG. 8(*a*) is a view from the link plate side of the vane adjustment mechanism, and FIG. 8(*b*) is a cross sectional view taken along line A—A of FIG. 8(*a*).

FIG. 9(*a*) is an enlarged view showing the variable vanes and lever, FIG. 9(*b*) is a protective cover for vanes shown from the vane side of the vane adjustment mechanism.

Figure 1A:
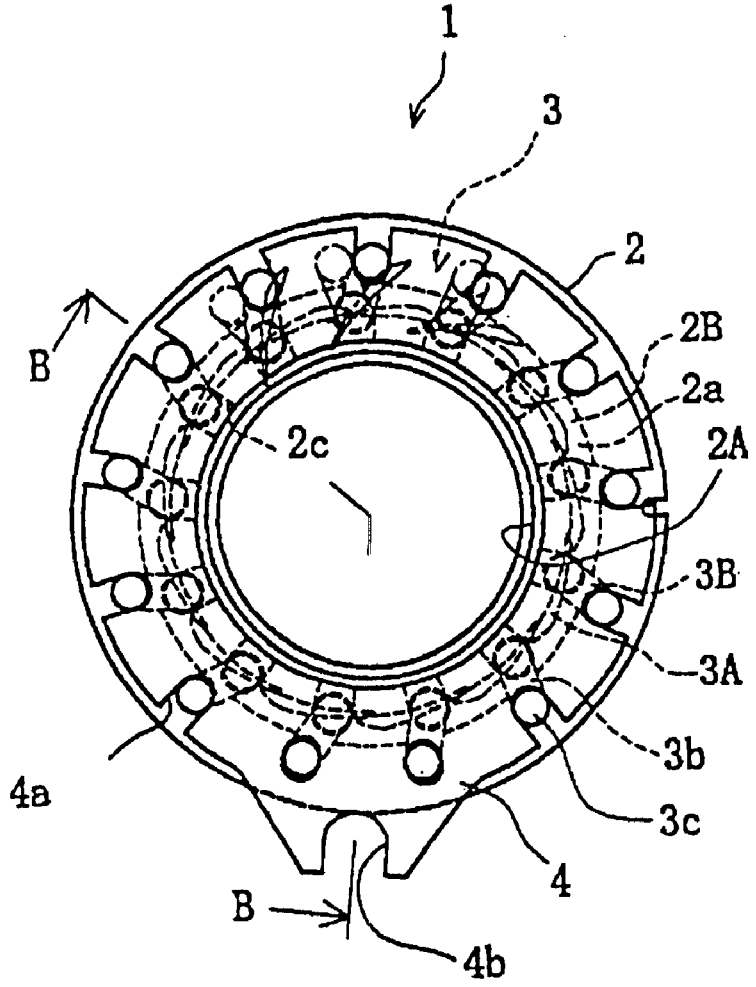
FIG. 1 is a rough sketch of the vane adjustment mechanism for a variable-capacity turbocharger in which this invention is implemented.

In the drawings, 1 is a vane adjustment mechanism, 2 is a base unit, 2A is an inner base unit, 2B is an outer base unit,

2*a* is a first flange, 2*b* is a second flange, 2*c* is an indentation, 3 is a vane lever unit, 3A is a vane, 3B is a lever, 3*a* is a vane shaft, 3*b* is a connector, 3*c* is a protrusion, 3*d* is a narrow portion, 4 is a link plate, 4*a* is a U-shaped cutting or concaved indentation, and 4*b* is an actuating portion.

DETAILED DESCRIPTION OF THE PREFERRED EMBODIMENTS

In this section we shall explain several preferred embodiments of this invention with reference to the appended drawings. Whenever the shapes, relative positions and other aspects of the parts described in these embodiments are not clearly defined, the scope of the invention is not limited only to the parts shown, which are meant merely for the purpose of illustration.

In the following section, we shall explain, with reference to FIGS. 1 through 6, a preferred embodiment of the vane adjustment mechanism to control the quantity of exhaust gas of this invention.

Figure 1B:
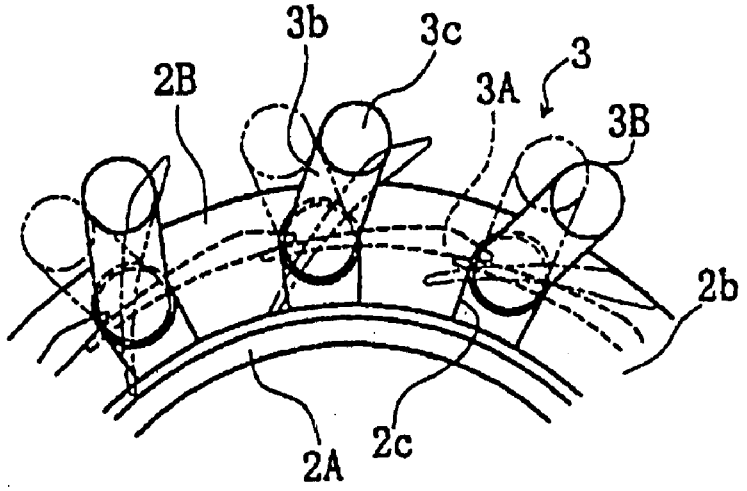
Figure 2:
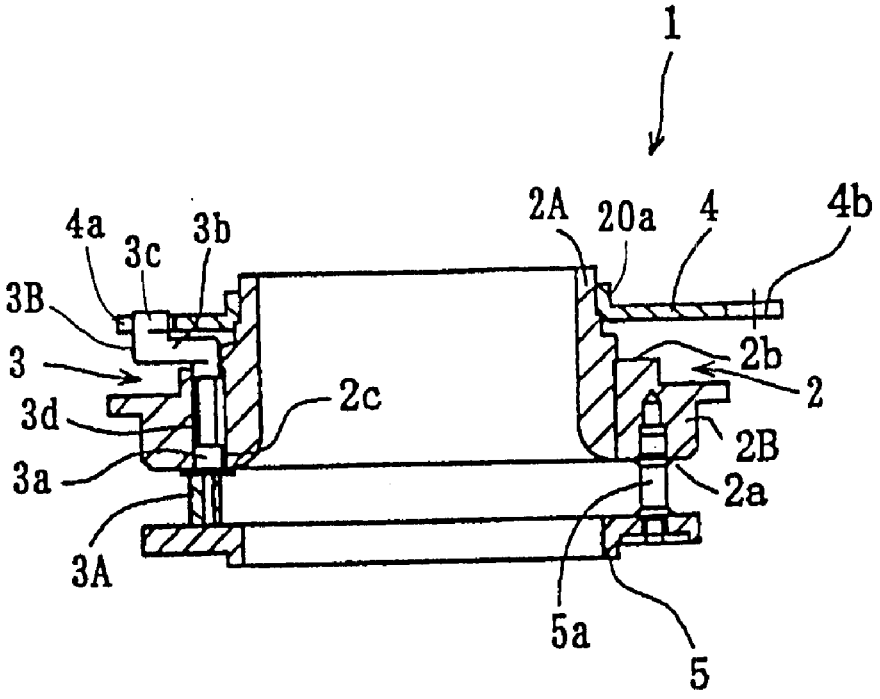
FIG. 2 is a cross sectional view taken along line B—B in FIG. 1 of the vane adjustment mechanism for a variable-capacity turbocharger in which this invention is implemented.
Figure 3A:
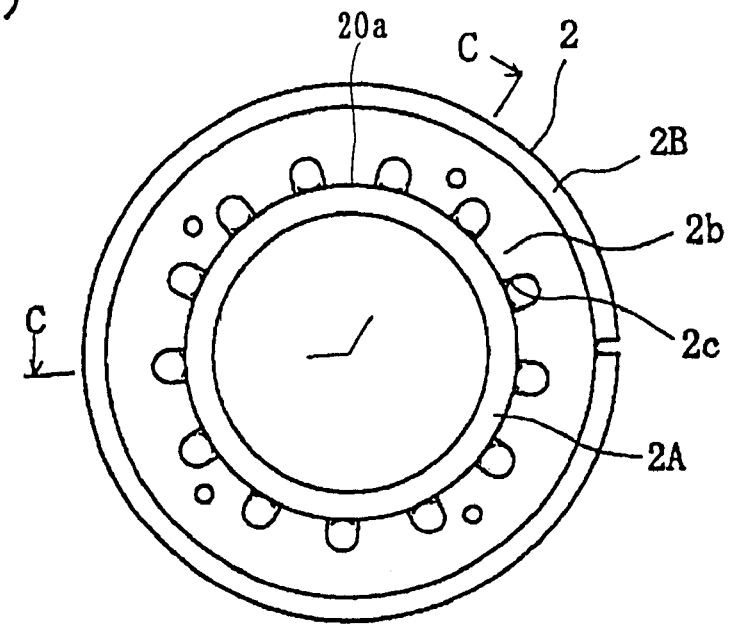
FIG. 3 shows the base unit of the mechanism to adjust the quantity of exhaust gas of this invention.
Figure 3B:
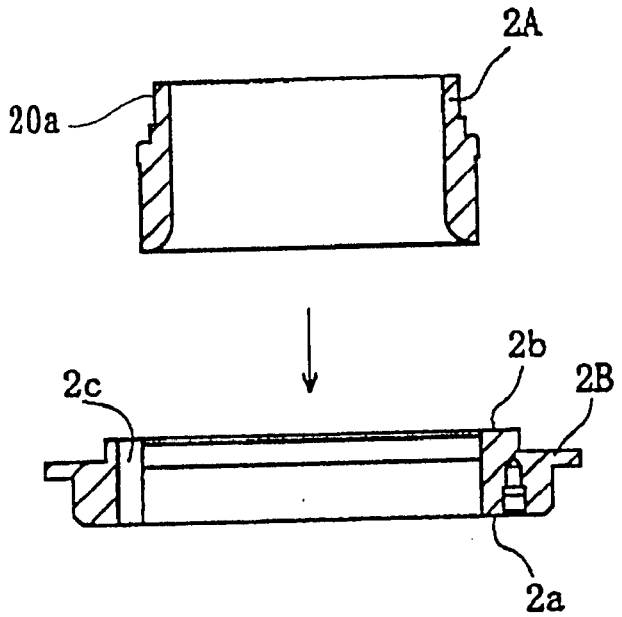
Figure 4A:
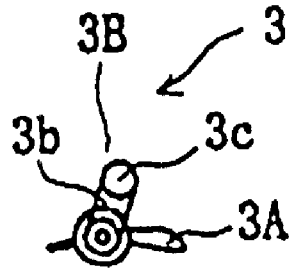
FIG. 4 shows the actuator vane link unit for the mechanism to adjust the vane angle of this invention.
Figure 4B:
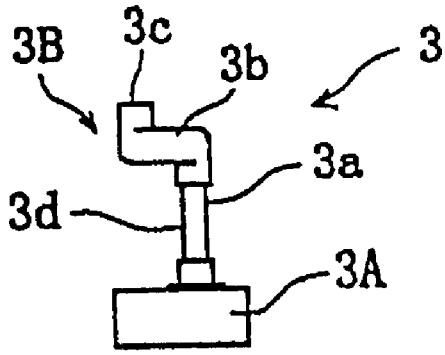
Figure 5A:
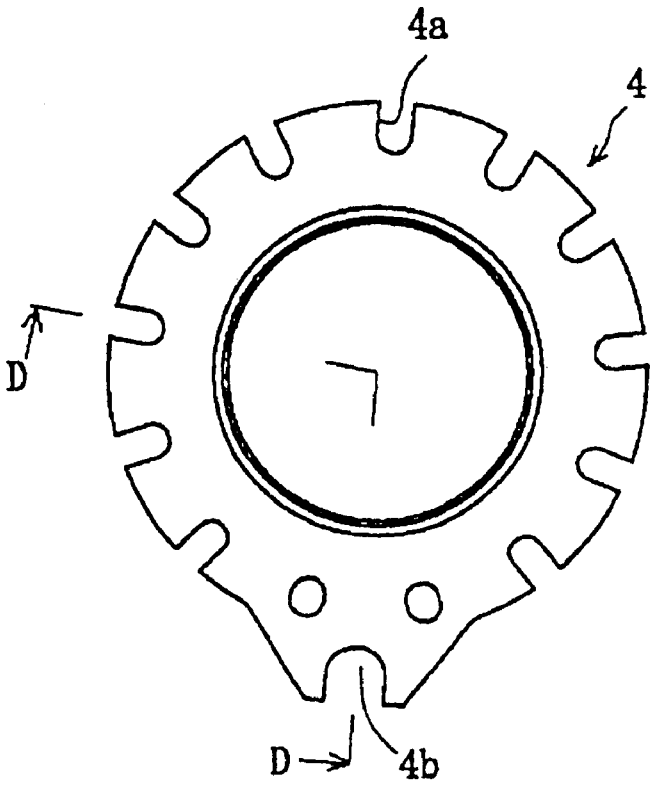
FIG. 5 shows a link plate of the vane adjustment mechanism of this invention.
Figure 5B:
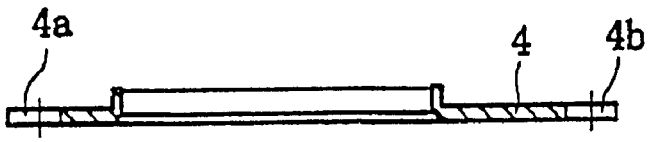
Figure 6A:
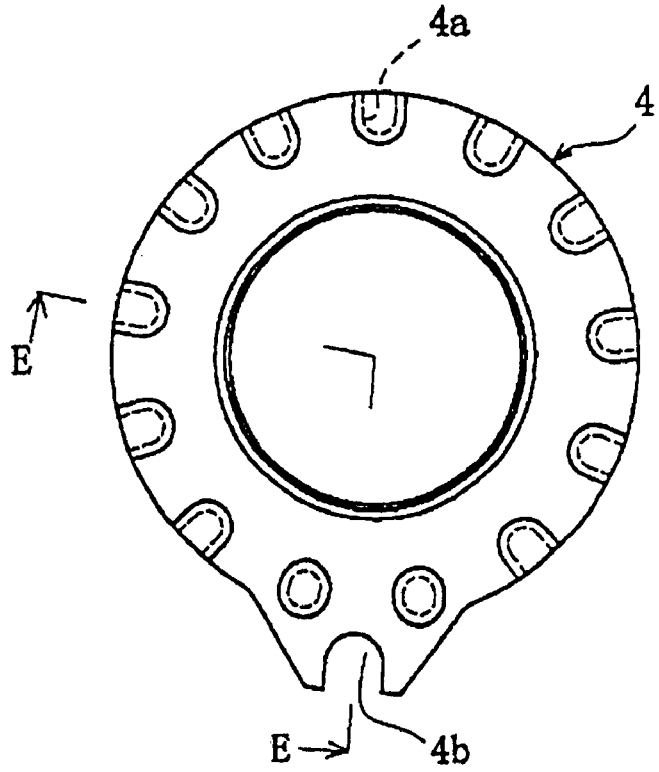
FIG. 6 shows a link plate of the vane adjustment mechanism of according to another preferred embodiment of this invention.
Figure 6B:
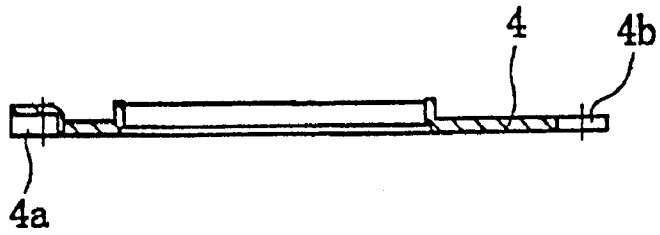
Figure 7:
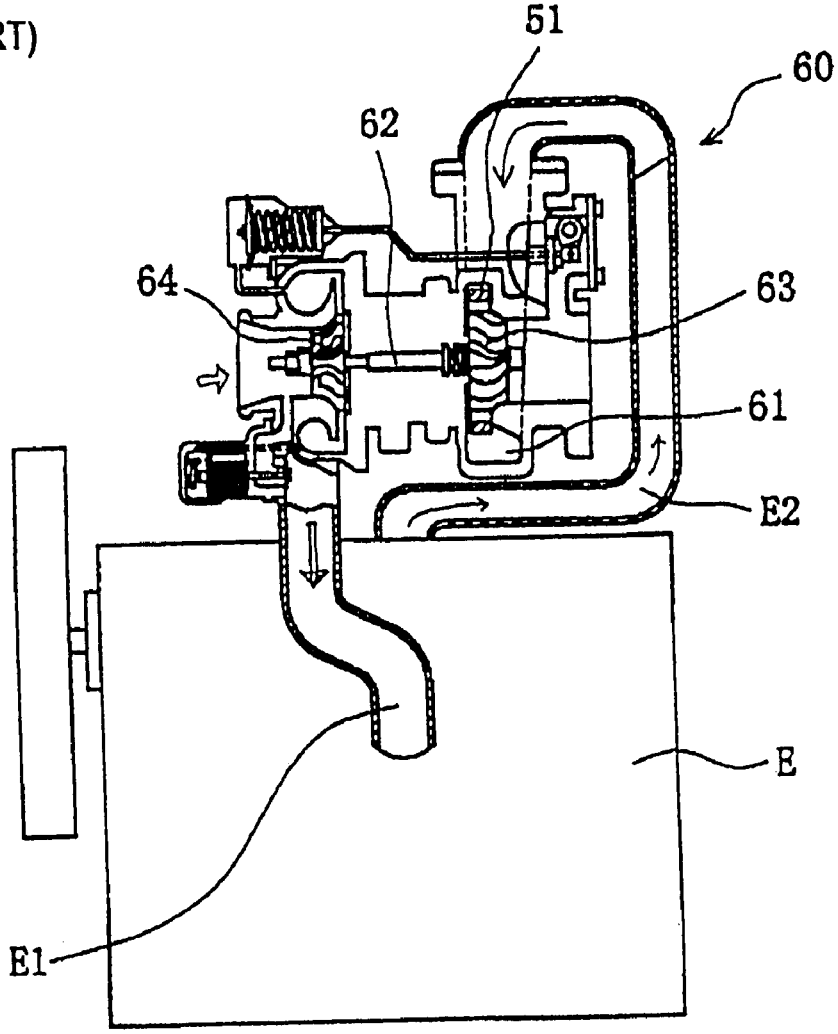
Fig. 7 (PRIOR ART)
FIG. 7 shows the location of the vane adjustment mechanism in an engine equipped with a prior art variable-capacity turbocharger.

FIGS. 1 and 2 show rough sketches of the configuration of the vane adjustment mechanism to control the quantity of exhaust gas for a variable turbocharger according to this invention. FIG. 3 shows the base unit of the mechanism to control the quantity of exhaust gas of this invention. FIG. 4 shows the vane lever unit to adjust the vane angle in the mechanism to control the quantity of exhaust gas of this invention. FIGS. 5 and 6 show the link plates in the mechanism to control the quantity of exhaust gas of this invention.

In FIGS. 1 through 6, 1 is the vane adjustment mechanism for controlling the quantity of exhaust gas of this invention. The vane adjustment mechanism 1 has vanes to control the quantity of exhaust gas which rotates the turbine blades. This mechanism is mounted in a turbocharger, which is not pictured, and is configured as will be explained.

2 is the base unit, which has the shape of a short pipe. As can be seen in FIG. 2, this base unit 2 consists of inner base unit 2A, which forms the inner portion of the base unit, and outer base unit 2B, into which inner base unit 2A is forced.

There are a flange 2*a* on the surface of outer base unit 2B and a second flange 2*b* on the opposite side. In this embodiment, outer base unit 2B has U-shaped indentations 2*c* at regular angular intervals on its inside surface all the way from flange 2*a* to flange 2*b*. In outer base unit 2B, flange 2*a*, flange 2*b* and indentations 2*c* are all formed from a single piece of material.

When inner base unit 2A, which can be seen in FIG. 3, is forced into outer base unit 2B, the open ends of indentations 2*c* on outer base unit 2B are covered by the outer surface of the inner base unit 2A. Thus, when inner base unit 2A and outer base unit 2B are assembled, indentations 2*c* function as vane shaft holes. A mechanism configured in this way will not require a drilling process.

As can be seen in FIG. 4, 3 is the vane lever unit. On one end of it is vane 3A, and on the other end is lever 3B which changes the angle of the surface of vane 3A. Both ends are formed as a single piece of material. In vane lever unit 3, vane 3A, which forms one end of the vane lever unit, is placed atop the flange 2*a* so that its surface is orthogonal to that of the flange. The angle of this surface is rotationally changed by means of lever 3B.

In vane lever unit 3, the lever 3B on one end of the unit consists of vane shaft 3*a*, which fits into the indentation 2*c* running from flange 2*a* to flange 2*b*; connector 3*b*, which extends parallel to flange 2*b* from the end of vane shaft 3*a*; and protrusion 3*c*, which extends perpendicular to flange 2*b* from the end of connector 3*b*.

In the mid-portion of vane shaft 3*a* is narrow portion 3*d*, which has a smaller diameter than the ends of the shaft. Narrow portion 3*d* reduces the contacting surface area of the shaft which is in contact with indentation 2*c* and so prevents the shaft from seizing in the indentation. The variable vane lever unit 3 is formed with vane 3A, vane shaft 3*a*, connector 3*b* and protrusion 3*c* in lever 3B, are all formed as a single piece unit.

4 is the link plate, whose inner circular edge engages with the outer edge of inner base unit 2A in such a way that it is free to rotate. The link plate 4 shown in FIG. 5, for example, has U-shaped cutting indentations 4*a*, in which protrusions 3*c* engage, all along its outer edge extending from one side to the other.

In the link plate 4 shown in FIG. 6, as another preferred embodiment, the U-shaped concaved indentations 4*a* in which protrusions 3*c* engage are punched by applying pressure from the reverse side of the plate. An actuating portion 4*b* of the outer edge of link plate 4 is provided, which engages with an actuator (not shown) to rotate the link plate 4.

In the link plate 4 shown in FIG. 5, instead of cutting indentations 4*a*, the portion where actuating portion 4*b* is formed has holes. However, if actuating portion 4*b* is placed on a portion of the plate where there are no cutting indentations 4*a*, the cutting indentations can be provided all around the outer edge of the link plate 4.

5 is a protective cover for vane 3A. (See FIG. 2.) Protective cover 5 is angular in shape. It is attached to flange 2*a* by means of connector hardware 5*a* with an interval between itself and the flange, which is slightly wider than the width of vane 3A.

When configured as described above, a vane adjustment mechanism 1 to control the quantity of exhaust gas in a turbocharger will, because of the way it is assembled, work as follows. When actuating portion 4*b* is driven to rotate over a given angle by an actuator (not pictured), link plate 4 will rotate over the same angle.

When link plate 4 rotates, protrusions 3*c* on levers 3B in vane lever unit 3, which engage with indentations 4*a* of link plate 4, also rotate. Connectors 3*b* will in turn rotate, causing vane shafts 3*a* to rotate on their axes. When vane shafts 3*a* rotate on their axes, the angle of the surface of vanes 3A in vane lever units 3 will change. This will adjust the quantity of exhaust gas which flows into inner base unit 2A.

Figure 8A:
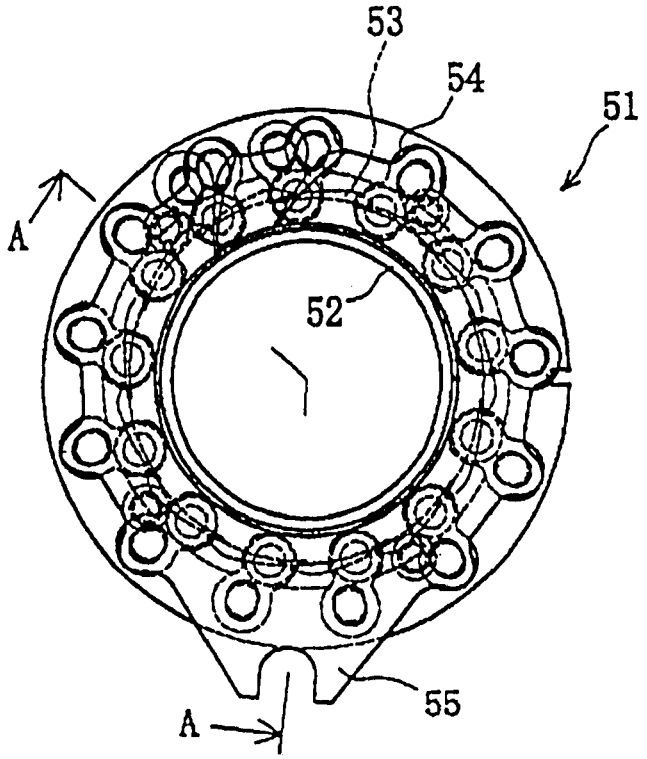
Fig. 8(a) (PRIOR ART)
FIG. 8 is a rough sketch of the vane adjustment mechanism for a prior art variable-capacity turbocharger.
Figure 8B:
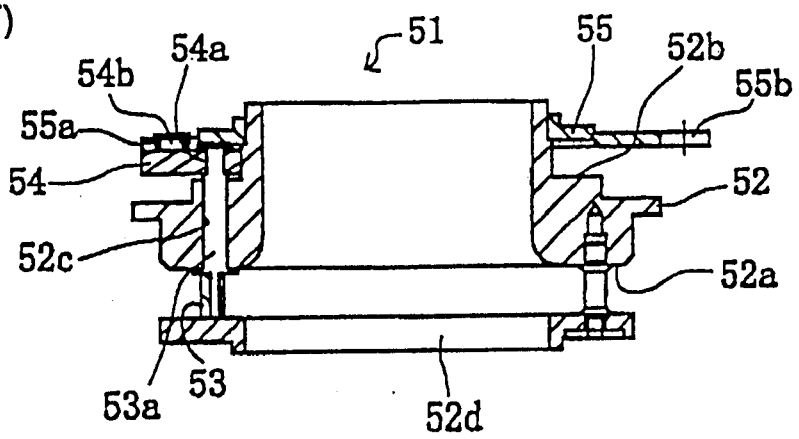
Fig. 8(b) (PRIOR ART)
Figure 9A:
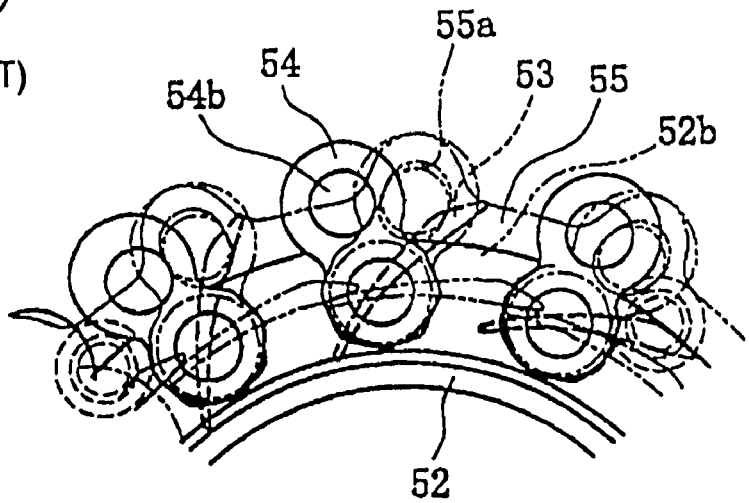
Fig. 9(a) (PRIOR ART)
FIG. 9 is a rough sketch of the vane adjustment mechanism for a prior art variable-capacity turbocharger.
Figure 9B:
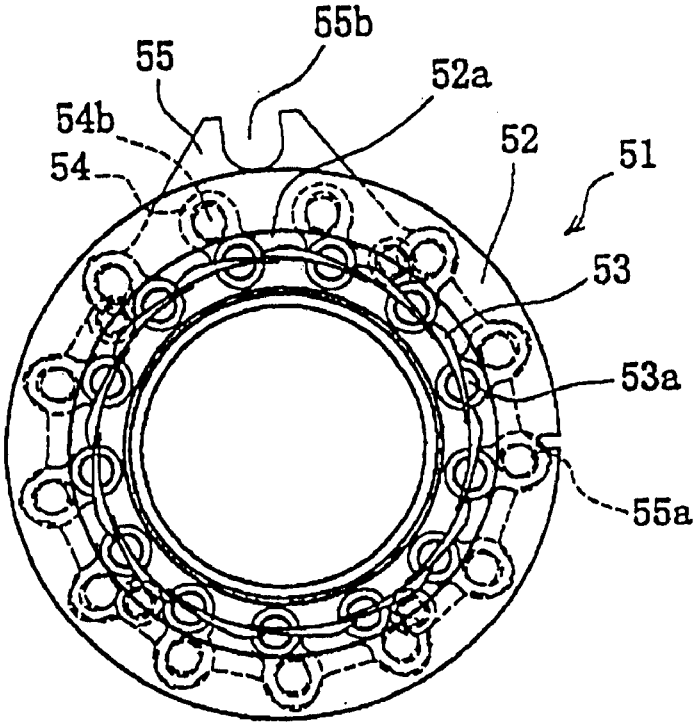
Fig. 9(b) (PRIOR ART)

We shall next explain the effects of this invention by considering how the vane adjustment mechanism 1 to control the quantity of exhaust gas, the embodiment of this invention, differs from mechanism 51, the prior art mechanism illustrated in FIGS. 8 and 9.

(1) In the prior art vane adjustment mechanism 51 to control the quantity of exhaust gas, vane shaft holes 52*c* are made in base unit 52 with a small-diameter drill bit for vane shafts 53*a* of nozzle vane units 53. Thus, a prior art mechanism 51 to control the quantity of exhaust gas required an equal amount of vane shaft holes 52*c* to be drilled, as there are nozzle vane units 53, which entailed considerable time and labor. Because the surfaces where vane shafts 53*a* met holes 52*c* have to be machined with great precision, even more time and labor is involved.

In contrast, the vane adjustment mechanism 1 to control the quantity of exhaust gas of this invention has indentations 2*c* which extend from flange 2*a* to flange 2*b* in outer base unit 2B of base unit 2. When inner base unit 2A is forced into outer base unit 2B, the open ends of indentations 2*c* are blocked by the outer surface of the inner base unit 2A. The indentations can then function as vane shaft holes which support vane shafts 3*a* of vane lever units 3 at three points.

Thus the indentations 2*c* in the vane adjustment mechanism 1 to control the quantity of exhaust gas of this invention can be created by broaching or cold forging the piece. When inner base unit 2A is forced into outer base unit 2B, indentations 2*c* can function as vane shaft holes which support the vane shafts at three points, as described above. This reduces the time and labor of machining and makes it less likely that vane shaft 3*a* will seize in the vane shaft holes formed by inner base unit 2A and indentations 2*c*.

(2) In the prior art vane adjustment mechanism 51 to control the quantity of exhaust gas, vane shafts 53*a* in nozzle vane units 53 are linear, and they are riveted to levers 54. Thus, vane shafts 53*a* (nozzle vane units 53) and levers 54 in prior art mechanisms 51 to control the quantity of exhaust gas required numerous parts. This affected both the parts count and the number of assembly processes. Also, just as was described above, the machining of the shafts required a great deal of precision, increasing the time, labor and cost of production.

In contrast, to produce vane lever unit 3 in the vane adjustment mechanism 1 to control the quantity of exhaust gas of this invention, each vane shaft 3*a*, connector 3*b* and protrusion 3*c* in vane 3A and lever 3B can be forged as a single piece. Thus, the mechanism 1 to control the quantity of exhaust gas of this invention requires fewer parts and, as a result, fewer assembly processes. The task of adjusting the angle at which lever 3B is mounted to vane 3A can be eliminated, thus significantly reducing the labor requirement.

(3) In the prior art vane adjustment mechanism 51 to control the quantity of exhaust gas, holes 55*a* in link plate 55 are actual holes into which fit protrusions 54*b* of levers 54. Thus, the prior art mechanism 51 to control the quantity of exhaust gas needed as many holes 55*a* as there are nozzle vane units 53, which required considerable labor to machine. Because the surfaces of protrusions 54*b* and holes 55*a* which came in contact with each other needed to be finished by precision machining, they are quite labor-intensive to produce.

In contrast, the vane adjustment mechanism 1 to control the quantity of exhaust gas of this invention has regular indentations 4*a* around link plate 4, into which protrusions 3*c* of levers 3B in vane lever units 3 engage. Because protrusions 3*c* in mechanism 1 to control the quantity of exhaust gas of this invention fit into indentations 4*a* of link plate 4 rather than into actual holes which are drilled, the components are much more resistant to thermal deformation as well as easier to machine.

Thus, the vane adjustment mechanism 1 to control the quantity of exhaust gas of this invention requires fewer parts than its predecessors, has a simpler configuration, and requires fewer precision machining processes. It can therefore be produced in a shorter time with better productivity and at a lower cost.

This invention is not limited to the embodiment described, but can be modified in various ways. For example, in the embodiment described above, indentations 2*c* are on the inner edge of outer base unit 2B, and inner base unit 2A is forced into the mount portion. However, indentations 2*c* can just as well be on the outer edge of inner base unit 2A, which will be forced into outer base unit 2B which has no indentations 2*c* on its inner edge. This will achieve the same operational effect as the configuration described above.

As has been discussed, the vane adjustment mechanism to control the quantity of exhaust gas related to the invention has U-shaped indentations at regular intervals along either the inner edge of the mount portion or the outer edge of the inner base unit. When the inner base unit is forced into the mount portion, the indentations function as vane shaft holes. The time and labor required to drill holes is eliminated, and the area which has to be precision-finished is smaller. The work is easier to finish, and the portions of the levers which engage in the indentations are much less likely to seize.

In the vane adjustment mechanism to control the quantity of exhaust gas, according to this invention, the vane which has a vane portion serving as a variable vane with a surface orthogonal to that of the first flange, a shaft, a connector and a protrusion, are made entirely as a single piece of material. This reduces the parts count and the number of assembly processes. It also eliminates the labor necessary to adjust the angle of the vane relative to the lever.

In the vane adjustment mechanism to control the quantity of exhaust gas according to this invention it has U-shaped indentations on the outer edge of the link plate which extend from one surface to the other, in which a protrusion of the lever in vane lever unit engages. This eliminates the labor of drilling holes in the plate, produces a product which is much less likely to thermally deform, and is easier to machine.

In the vane adjustment mechanism to control the quantity of exhaust gas according to this invention, the mid-portion of each vane shaft of the vane lever unit goes into an indentation that is narrowed. This reduces the surface area where the shaft makes contact with the indentation, shortens the machining time required to precision-finish the piece, and prevents the two parts from seizing.

What is claimed is:

1. A vane adjustment mechanism used in a variable-capacity turbine to control the quantity of exhaust gas, the vane adjustment mechanism comprising:

a base unit having the shape of a short pipe, said base unit having a first flange on an outer surface and a second flange on an inner side with respect to the direction of exhaust gas flow, wherein said base unit comprises an inner base unit having said first and second flanges, and an outer base unit into which said inner base unit is inserted;

a plurality of vanes, positioned along the circumference of said base unit, for adjusting the quantity of exhaust gas;

a link plate having an inner circular edge that engages with an outer edge of said base unit in such a way that said link plate is free to rotate;

a plurality of vane lever units connecting said plurality of vanes and said link plate, wherein said vane lever units run through vane shaft holes in said base unit; and a plurality of U-shaped indentations spaced at regular angular intervals on the inside surface of said inner base unit or said outer base unit from said first flange to said second flange, so that said U-shaped indentations form said vane shaft holes to accommodate said vane lever units when said inner base unit is inserted into said outer base unit to block said U-shaped indentations in such a way that said vane lever units are free to rotate, wherein the mid-portion of a vane shaft of each of said vane lever units has a narrow portion which has a smaller diameter than the ends of said vane shaft, which reduces the contacting surface area with said U-shaped indentation so as to prevent said vane shaft from seizing in said U-shaped indentation.

2. A vane adjustment mechanism according to claim 1, where an outer circumferential surface of said inner base unit engages with a rounded center portion of said link plate in such a way that said link plate is free to rotate.

3. A vane adjustment mechanism according to claim 1, wherein each of said vanes and said corresponding vane lever unit are formed as an integral piece.

4. A vane adjustment mechanism according to claim 1, wherein said link plate has U-shaped indentations, in which protrusions of said vane lever units engage, all along the circumferential edge of said link plate.

5. A method of assembling a vane adjustment mechanism used in a variable-capacity turbine to control the quantity of exhaust gas, said vane adjustment mechanism comprising:

a base unit having the shape of a short pipe, said base unit having a first flange on an outer surface and a second flange on an inner side with respect to the direction of exhaust gas flow;

a plurality of vanes, provided along the circumference of said base unit, for adjusting the quantity of exhaust gas;

a link plate having an inner circular edge that engages with an outer edge of said base unit in such a way that said link plate is free to rotate; and a plurality of vane lever units connecting said plurality of vanes and said link plate;

said assembling method comprising:

providing a plurality of U-shaped indentations spaced at regular angular intervals on one of an outside surface of said inner base unit and an inside surface of said outer base unit, wherein each U-shaped indentation extends from said first flange to said second flange, so that said U-shaped indentations form vane shaft holes to accommodate said vane lever units;

positioning said vane lever units in said U-shaped indentations, respectively; and inserting said inner base unit into said outer base unit to block said U-shaped indentations in such a way that said vane lever units are free to rotate, wherein the mid-portion of a vane shaft of each of said vane lever units has a narrow portion which has a smaller diameter than the ends of said vane shaft, which reduces the contacting surface area with said respective U-shaped indentation so as to prevent said vane shaft from seizing in said respective U-shaped indentation.

* * * * *